United States Patent [19]

Hiraga et al.

[11] 4,456,435

[45] Jun. 26, 1984

[54] SCROLL TYPE FLUID DISPLACEMENT APPARATUS

[75] Inventors: Masaharu Hiraga, Honjyo; Seiichi Sakamoto, Gunma, both of Japan

[73] Assignee: Sanden Corporation, Gunma, Japan

[21] Appl. No.: 546,632

[22] Filed: Oct. 28, 1983

Related U.S. Application Data

[63] Continuation of Ser. No. 277,109, Jun. 25, 1981, abandoned.

[30] Foreign Application Priority Data

Jul. 1, 1980 [JP] Japan ..... 55-90391

[51] Int. Cl.³ ..... F04B 49/02; F04B 49/06; F04C 18/02

[52] U.S. Cl. ..... 417/302; 417/308; 417/310; 418/55

[58] Field of Search ..... 417/302, 308, 310; 418/55

[56] References Cited

U.S. PATENT DOCUMENTS

| | | | |
|---|---|---|---|
| 2,062,052 | 11/1936 | Horlacher | 417/302 X |
| 3,628,893 | 12/1971 | Carpigiani | 417/310 |
| 3,734,648 | 5/1973 | Nielson | 417/310 |
| 3,884,599 | 5/1975 | Young et al. | 418/55 |
| 4,192,152 | 3/1980 | Armstrong et al. | 62/402 |
| 4,216,661 | 8/1980 | Tojo et al. | 62/505 |
| 4,314,796 | 2/1982 | Terauchi | 418/55 X |
| 4,343,599 | 8/1982 | Kousokabe | 418/55 |
| 4,383,805 | 5/1983 | Teegarden et al. | 417/308 |

FOREIGN PATENT DOCUMENTS

| | | | |
|---|---|---|---|
| 2812594 | 10/1978 | Fed. Rep. of Germany | 418/55 |
| 2195270 | 3/1974 | France . | |

*Primary Examiner*—Richard E. Gluck

*Attorney, Agent, or Firm*—Banner, Birch, McKie & Beckett

[57] ABSTRACT

A scroll type fluid displacement apparatus is disclosed. The apparatus includes a housing. A fixed scroll member fixedly disposed within the housing and comprises a first end plate means from which a first wrap means extends. An orbiting scroll member also comprises a second end plate means from which a second wrap means extends. Both wrap means interfit at an angular and radial offset to make a plurality of line contacts to define at least one pair of symmetrical sealed off fluid pockets. The first end plate means is formed with two holes which are placed at the symmetrical position. A valve means controls the passage of fluids through the holes. The valve means is controlled by the changes of the external environment. The capacity of compressor can thereby be easily changed in response to the changes in the external environment.

17 Claims, 10 Drawing Figures

SCROLL TYPE FLUID DISPLACEMENT APPARATUS

This application is a continuation of application Ser. No. 277,109, filed June 25, 1981, now abandoned.

BACKGROUND OF THE INVENTION

This invention relates to fluid displacement apparatus, and more particularly, to a fluid compressor unit of scroll type.

Scroll type fluid displacement apparatus are well known in the prior art. For example, U.S. Pat. No. 801,182 discloses a device including two scroll members each having a circular end plate and a spiroidal or involute spiral element. These scroll members are maintained angularly and radially offset so that both spiral elements interfit to make a plurality of line contacts between both spiral curved surfaces of the spiral elements, to thereby seal off and define at least one pair of fluid pockets. The relative orbital motion of the two scroll members shifts the line contact along the spiral curved surfaces and, therefore, the fluid pockets change in volume. The volume of the fluid pockets increases or decreases dependent on the direction of the orbital motion. Therefore, the scroll type apparatus is applicable to compress, expand or pump fluids.

Such a scroll type fluid displacement apparatus is suited for use as a refrigerant compressor for an automobile air conditioner. In such air conditioners, generally, thermal control in the passenger compartment or control of the air conditioner is accomplished by intermittent operation of the compressor unit through a magnetic clutch which is connected to the compressor and activated by a signal from the thermostat disposed in a passenger compartment. If the temperature in the passenger compartment has been cooled down to a desired temperature, the refrigerating capacity of the air conditioner for supplemental cooling because of further temperature changes in the passenger compartment, or, for keeping the passenger compartment at the desired temperature, need not be of such large capacity. However, prior air conditioners do not have capacity control means. Therefore, after the passenger compartment has been cooled to the desired temperature, the only manner for controlling the output of the compressor is by intermittent operation of the compressor through the magnetic clutch which follows small changes of temperature in the passenger compartment by means of the thermostat. Whereby, the large load to drive the compressor is intermittently applied to the engine shaft which is connected to the compressor through the magnetic clutch for accomplishing the rotary movement of the compressor drive.

SUMMARY OF THE INVENTION

It is a primary object of this invention to provide an improvement in a scroll type fluid compressor unit which has a displacement volume changing means, whereby the load acting on the power source is reduced under certain conditions of car air conditioner operation.

It is another object of this invention to provide an improvement in a scroll type fluid compressor unit wherein the life of the compressor unit is improved.

It is still another object of this invention to provide a scroll type fluid compressor unit which is simple in construction and production and accomplishes the above described objects.

A scroll type fluid compressor unit according to this invention includes a pair of scroll members. Each scroll member is comprised of end plate means and a wrap means extends from a side surface of the end plate means. Both wrap means interfit at an angular offset to make a plurality of line contacts and define at least one pair of sealed off fluid pockets between both wrap means. One of the scroll members undergoes orbital motion by the rotation of a drive shaft while the rotation of the one scroll member is prevented. The fluid pockets shift along the direction of the orbital motion whereby the fluid pockets change their volume. One of the end plate means has two holes formed through it. The holes are placed in symmetrical positions for the wrap means of the other scroll member to simultaneously cross over the holes. A control means is disposed at the holes for controlling the opening and closing of the holes. The displacement volume of each fluid pocket is controlled to start the compression at an intermediate state by the opening and closing of these holes through the control means.

In another aspect of this invention, a fluid passage means for connecting between these two holes is provided. An aperture is formed on the fluid passage means to connect a passageway of the fluid passage means with a suction chamber, i.e., a low pressure area. The control means is disposed at the opening of the aperture to control communication between the two holes and the low pressure area. Therefore, the capacity of the compressor changes by changing the compression starting volume of the fluid pockets through the opening of the aperture, which in turn, can be controlled by external environment conditions, such as the temperature in the passenger compartment.

Further objects, features and other aspects of this invention will be understood from the detailed description of preferred embodiments of this invention with reference to the annexed drawings.

DETAILED DESCRIPTION OF THE PREFERRED EMBODIMENT

Before the preferred embodiments of this invention are described, the principle of operation of a scroll type compressor unit is described with reference to FIGS. 1*a*–1*d*. The scroll type compressor unit is operated by moving a sealed off fluid pocket from a low pressure region to a high pressure region.

Figure 1A:
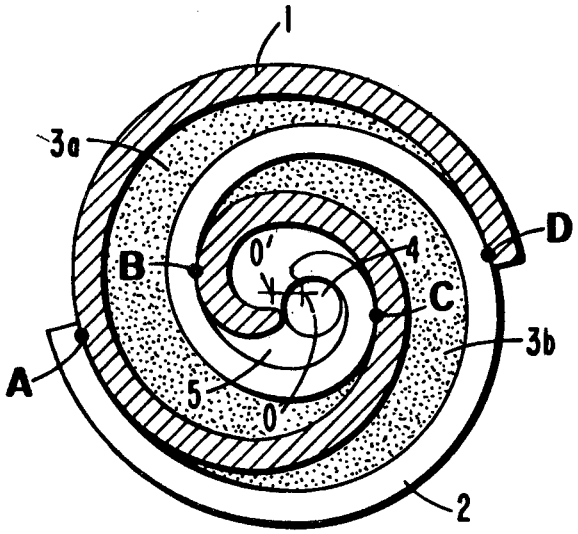
FIGS. 1*a*–1*d* are schematic views illustrating the movement of interfitting spiral elements to compress a fluid.

FIGS. 1*a*–1*d* may be considered end views of a compressor wherein the end plate is removed and only spiral elements are shown. Two spiral elements 1 and 2 are angularly and radially offset and interfit with one another. As shown in FIG. 1*a*, the orbiting spiral element 1 and fixed spiral element 2 make four line contacts as shown at four points A-D. A pair of fluid pockets 3*a* and 3*b* are defined between line contacts D-C and line contacts A-B, as shown by the dotted regions. The pair of fluid pockets 3*a* and 3*b* are defined not only by the walls of both spiral elements 1 and 2 but also by the end plates from which these spiral elements extend. When orbitig spiral element 1 is moved in relation to fixed spiral element 2 in such a manner that center o' of orbiting spiral element 1 revolves around the center O of fixed spiral element 2 with a radius of o-0' and the rotation of orbiting spiral element 1 is prevented, the location of the pair of fluid pockets 3*a* and 3*b* shifts angularly and radially towards the center of the interfitted spiral elements with the volume of each fluid pocket 3*a* and 3*b* being gradually reduced, as shown in FIGS. 1*a*–1*d*. Therefore, the fluid in each pocket 3*a*, 3*b* is compressed.

Figure 1B:
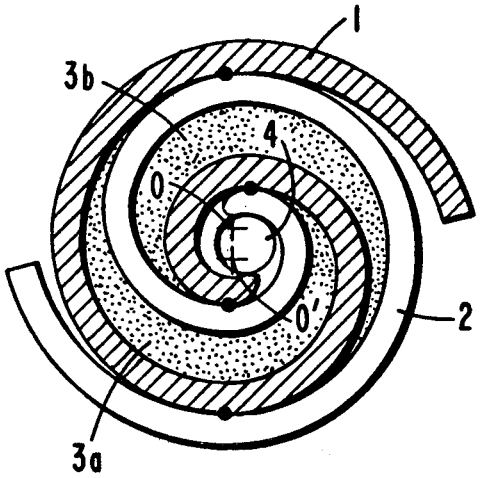
Figure 1C:
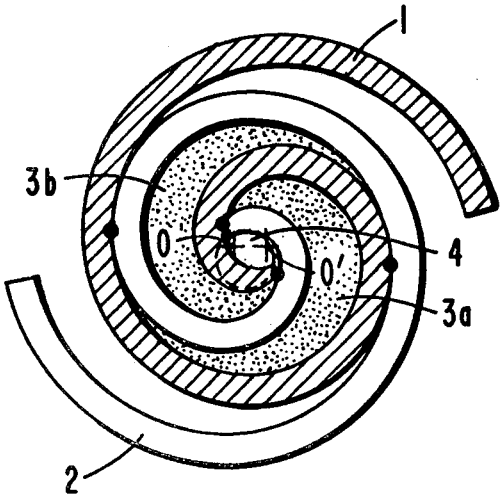
Figure 1D:
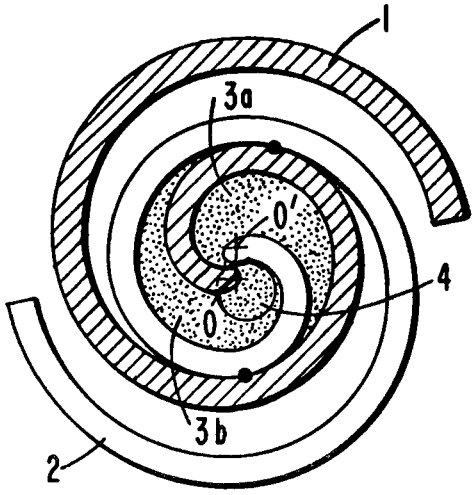

The pair of fluid pockets 3*a* and 3*b* are connected to one another while passing the stage from FIG. 1*c* to FIG. 1*d*, and after rotation through a 360° angle as shown in FIG. 1*a*, both fluid pockets 3*a* and 3*b* are disposed at the center portion 5 and are completely connected to one another to form a single pocket. The volume of the connected single pocket is further reduced by further revolution of 90°, as shown in FIGS. 1*b* and 1*c*. During the course of rotation outer spaces which open in the state shown in FIG. 1*b* change as shown in FIGS. 1*c*, 1*d* and 1*a*, to form new sealed off pockets in which fluid is newly enclosed as shown in FIG. 1*a*.

Accordingly, if circular end plates are disposed on, and sealed to, the axial faces of spiral elements 1 and 2, respectively, and if one of the end plates is provided with a discharge port 4 at the center thereof as shown in the figures, fluid is taken into the fluid pockets at the radial outer portions and is discharged from the discharge port 4 after compression.

Figure 2:
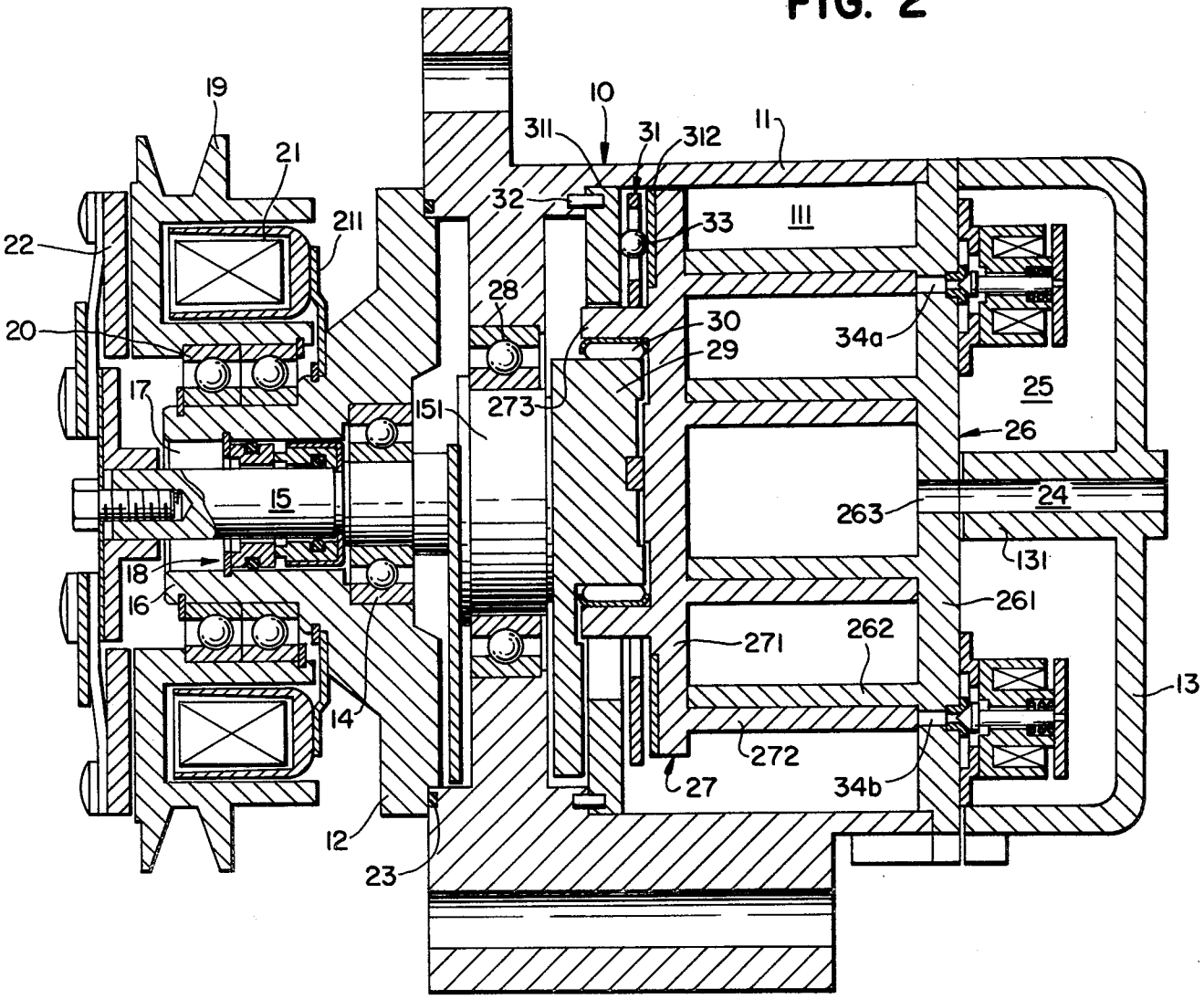
FIG. 2 is a vertical sectional view of a compressor unit of the scroll type according to an embodiment of this invention.

Referring to FIG. 2, a refrigerant compressor unit of the embodiment shown includes a compressor housing 10 comprising a cylindrical housing 11, a front end plate 12 disposed to a front end portion of cylindrical housing 11 and a rear end plate 13 disposed to a rear end portion of cylindrical housing 11. An opening is formed in front end plate 12 and a drive shaft 15 is rotatably supported by a bearing means, such as a ball bearing 14 disposed in the opening. Front end plate 12 has an annular sleeve portion 16 projecting from the front end surface thereof and surrounding driver shaft 15 to define a shaft seal cavity 17. A shaft seal assembly 18 is assembled on drive shaft 15 within shaft seal cavity 17. A pulley 19 is rotatably supported by a bearing means 20 which is disposed on the outer surface of sleeve portion 16. An electromagnetic annular coil 21 is fixed to the outer surface of sleeve portion 16 by a support plate 211 and is received in an annular cavity of pulley 19. An armature plate 22 is elastically supported on the outer end of drive shaft 15 which extends from sleeve portion 16. A magnetic clutch comprising pulley 19, magnetic coil 21 and armature plate 22 is thereby formed. Thus, drive shaft 15 is driven by an external drive power source, for example, an engine of a vehicle through a rotational force transmitting means such as the above mentioned magnetic clutch.

Front end plate 12 is fixed to the front end portion of cylindrical housing 11 by bolts (not shown), to thereby cover an opening of cylindrical housing. A seal is formed about the opening by a seal member 23 disposed between facing surfaces of the front end plate 12 and the cylindrical housing 11. Rear end plate 13 is provided with an annular projection 131 to form a discharge passageway 24. The projection 131 extends inwardly whereby an inner chamber of rear end plate 13 is divided into a suction chamber 25 and discharge passageway 24 by projection 131. Rear end plate 13 has a fluid inlet port and a fluid outlet port, which respectively are connected to the suction chamber 25 and discharge passageway 24. Rear end plate 13 together with a circular end plate 261 of fixed scroll member 26 is fixed to rear end portion of cylindrical housing 11 by bolts-nuts (not shown). Circular end plate 261 of fixed scroll member 26 is disposed between cylindrical housing 11 and rear end plate 13 and is secured to cylindrical housing 11. The opening of the rear end portion of cylindrical housing 11 is thereby covered by circular end plate 261. Therefore, an inner chamber 111 is sealed to form a low pressure space in cylindrical housing 11.

Fixed scroll member 26 includes circular end plate 261 and a wrap means or spiral element 262 affixed to or extending from one side surface of circular plate 261. Spiral element 262 is disposed in inner chamber 111 of cylindrical housing 11. A hole or suction port (not shown) is formed through circular plate 261 which communicates between suction chamber 25 and inner chamber 111 of cylindrical housing 11. A hole or discharge port 263 is formed through circular plate 261 at a position near to the center of spiral element 262 and is connected to discharge passageway 24.

An orbiting scroll member 27 is also disposed in inner chamber 111. Orbiting scroll member 27 also comprises a circular end plate 271 and a wrap means or spiral element 272 affixed to or extending from one side surface of circular plate 271. The spiral elements 262, 272 interfit at an angular offset of 180° and a predetermined radial offset to make a plurality of line contacts and define at least one pair of sealed off fluid pockets between both spiral elements 262, 272. Orbiting scroll member 27 is connected to a driving mechanism and a rotation preventing/thrust bearing mechanism. These two mechanisms effect orbital motion by rotation of drive shaft 15 to thereby compress fluid in the fluid pockets as the fluid passes through the compressor unit.

Driving mechanism of orbiting scroll member 27 includes drive shaft 15, which is rotatably supported by front end plate 12 through ball bearing 14. Drive shaft 15 is formed with a disk portion 151 at its inner end portion. Disk portion 151 is rotatably supported by a bearing means, such as a ball bearing 28, which is disposed in a front end opening of cylindrical housing 11. A crank pin or drive pin projects axially from an end surface of disk portion 151 and is radially offset from the center of drive shaft 15. Circular plate 271 of orbiting scroll member 27 is provided with a tubular boss 273 projecting axially from an end surface, which is opposite the side thereof from which spiral element 272 extends. A discoid or short axial bushing 29 is fitted into boss 273, and rotatably supported therein by a bearing means, such as a needle bearing 30. An eccentric hole (not shown) is formed in bushing 29 radially offset from the center of bushing 29. The drive pin is fitted into the eccentrically disposed hole. Bushing 29 is therefore driven by the revolution of the drive pin and permitted to the rotate by needle bearing 30. Orbiting scroll member 27 is thereby allowed to undergo the orbital motion by the rotation of drive shaft 15, while the rotation of orbiting scroll member 27 is prevented by the rotation preventing mechanism 31.

Rotation preventing mechanism 31 is disposed around boss 273 and comprises an Oldham plate 311 and an Oldham ring 312. Oldham plate 311 is secured to a stepped portion of the inner surface of cylindrical housing 11 by pins 32. Oldham ring 312 is disposed in a hollow space between Oldham plate 311 and circular plate 271 of orbiting scroll member 27. Oldham plate 311 and Oldham ring 312 are connected by keys and keyways whereby Oldham ring 312 is slidable in a first radial direction. Oldham ring 312 and circular plate 271 also are connected by keys and keyways whereby orbiting scroll member 27 is slidable in a second radial direction which is perpendicular to the first radial direction.

Accordingly, orbiting scroll member 27 is slidable in one radial direction with Oldham ring 312, and is slidable in another radial direction independently. The second radial direction is perpendicular to the first radial direction. Therefore, orbiting scroll member 27 is prevented from rotating, but is permitted to move in two radial directions perpendicular to one another.

Oldham ring 312 is provided with a plurality of holes or pockets, and a bearing means, such as balls 33, each having a diameter which is longer than the thickness of Oldham ring 312. The balls 33 are retained in pockets of Oldham ring 312. Balls 33 contact and roll on the surface of Oldham plate 311 and circular plate 271. Therefore, the thrust load from orbiting scroll member 27 is supported on Oldham plate 311 through balls 33.

When drive shaft 15 is rotated by the external drive power source through the magnetic clutch, the drive pin is eccentrically moved by the rotation of drive shaft 15. Eccentric bushing 29 is driven eccentrically because it follows the motion of the drive pin. Therefore, orbiting scroll member 27 is allowed to undergo the orbital motion, while the rotation of orbiting scroll member 27 is prevented by rotation preventing mechanism 31. The fluid, or refrigerant gas, introduced into suction chamber 25 is taken into a pair of fluid pockets from outer end of spiral elements 262, 272, and, as orbiting scroll member 27 orbits, fluid in the fluid pocket is moved to the center of the spiral element with a consequent reduction of volume. The compressed fluid is discharged into discharge passageway 24 from the fluid pocket of spiral element center through discharge port 263, and therefrom, discharged through the outlet port to an external fluid circuit, for example, a cooling circuit.

Figure 3:
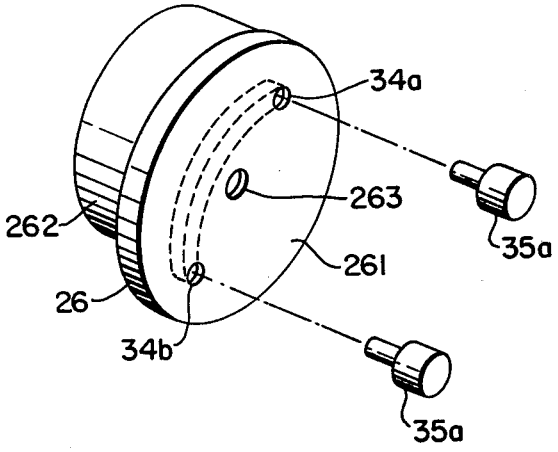
FIG. 3 is an exploded perpective view of a fixed scroll member in one embodiment of this invention.

Two holes **34*a* and 34*b* are formed in circular plate 261 of fixed scroll member 26 and are placed at symmetrical positions so that an axial end surface of spiral element 272 of orbiting scroll member 27 simultaneously crosses over the two holes. A control means 35 is disposed at one end opening of each hole 34*a*, 34*b* to control the opening and closing of each hole, as shown in FIG. 3**.

Figure 5:
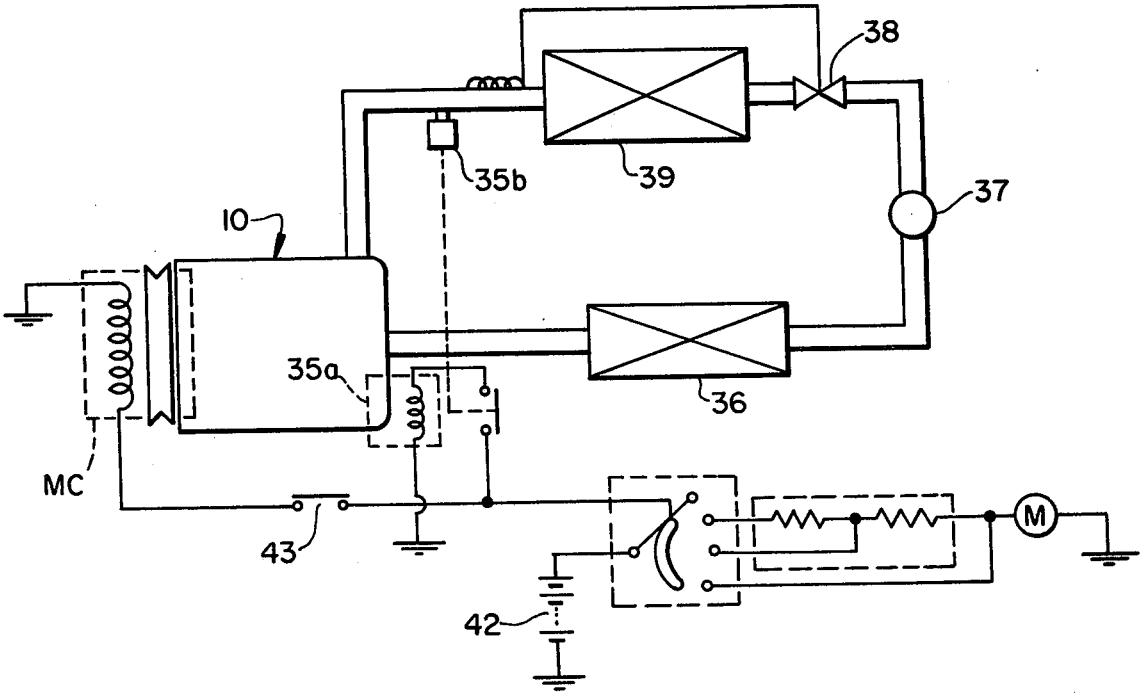
FIG. 5 is a schematic view illustrating an air conditioning control circuit.

A refrigerant circuit for an automobile air conditioner is illustrated in FIG. 5. The circuit includes a condenser 36, one end portion of which is conncted to the fluid outlet port of the compressor 10, a receiver/dryer 37, an expansion valve 38 and an evaporator 39, one end portion of which is connected to the fluid inlet port of the compressor 10. The magnetic clutch MC is connected to a battery 42 which is controlled through a thermostat 43 disposed in the passenger compartment of the automobile.

Valve means 35 comprises a means for controlling the passage of fluids through the holes 34. Valve means 35 includes a magnetic solenoid valve means **35*a* and a detecting means 35*b*. In one embodiment of this invention, as shown in FIG. 5, detecting means 35*b* is disposed on the outlet portion of evaporator 39 for detecting outlet pressure of evaporator 39. Therefore, magnetic solenoid valve means 35*a* is controlled by the pressure different of evaporator 39 through detecting means 35*b*. Because the pressure of the evaporator outlet depends on the air temperature which passes through the evaporator for heat exchange, the outlet pressure is dependent on the air temperature. Usually, the outlet pressure of the evaporator lowers as the temperature in the evaporator lowers. Such a condition generally occurs when the temperature in the passenger compartment has been lowered to a desired temperature level and only a small or gradual elevation of the temperature occurs, because the temperature of the air passing through the evaporator is relatively low. To hold the car interior temperature at the desired level, operation of the compressor at its full capacity is not required and also it is not desirable because such operation places a high load on the engine. The opening of holes 34*a*, 34*b*** allow the compression capacity of the compressor to be lowered to thereby lower the load on the engine under such a condition.

Referring to FIG. 1 and FIG. 6, the operation of a displacement volume changing means for the fluid pockets will be described.

When the terminal end portion of both spiral elements 262, 272 are fitted against opposite sidewalls of the other spiral element by the orbital motion of orbiting scroll member 26, a pair of fluid pocket **3*a*, 3*b* are sealed off and symmetrically formed at the same time, as shown in FIG. 1*a*. If the two holes 34*a*, 34*b* are closed by magnetic valve means 35*a*, the compression is normally operated, as described above referring to FIGS. 1*a*–1*d***.

Figure 6A:
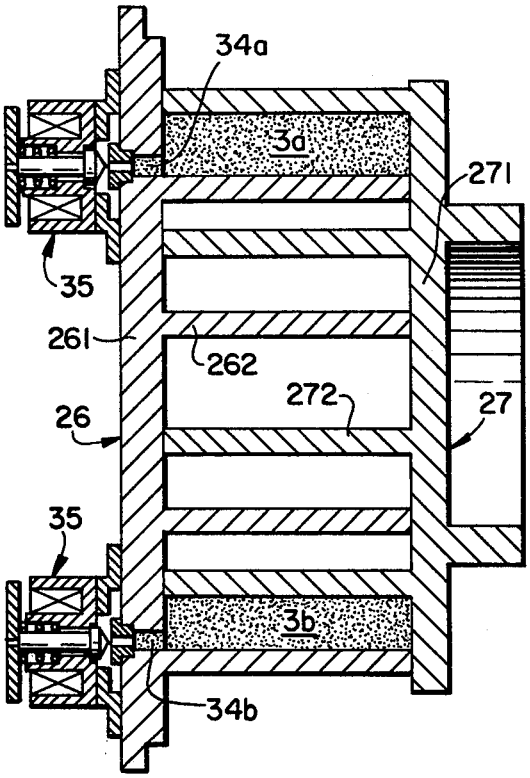
FIGS. 6*a*–6*d* are schematic views illustrating the operation of volume changing means.
Figure 6B:
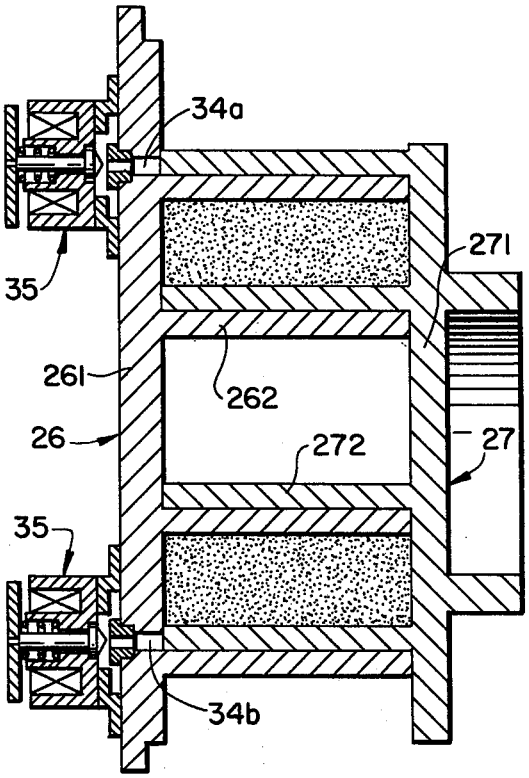
Figure 6C:
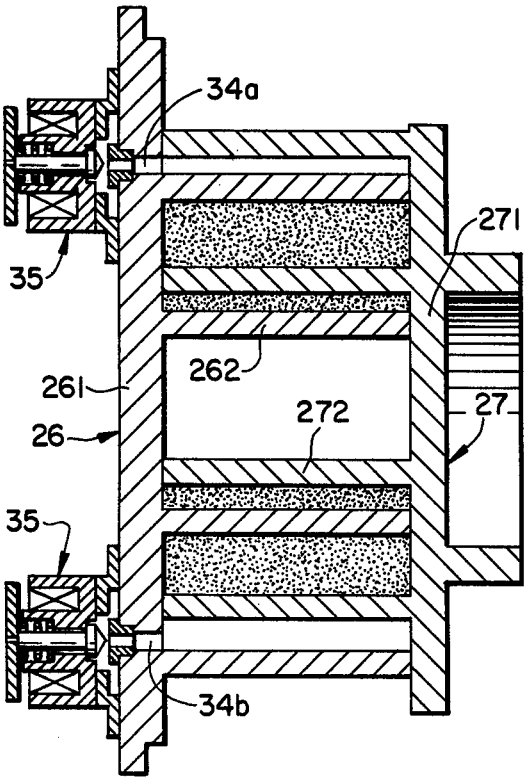
Figure 6D:
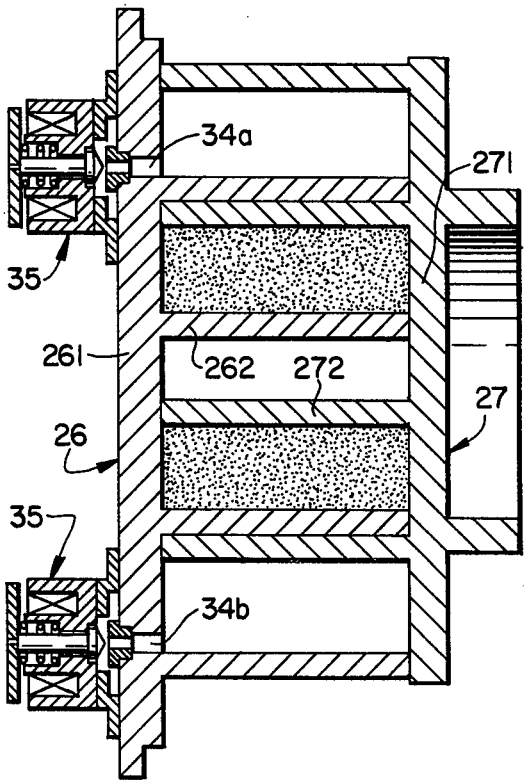

When detecting means **35*b* detects a pressure in the fluid circuit below the desired pressure, magnetic valve means 35*a* is operated to open holes 34*a*, 34*b*. Therefore, the fluid which has been taken into the sealed off fluid pocket is leaked from the sealed off fluid pockets 3*a*, 3*b* to suction chamber 25 of rear end plate 13, as shown in FIG. 6*a*. This leaking state continues until the axial end surface of spiral element 271 of orbiting scroll member 27 passes over the holes 34*a*, 34*b*, as shown in FIG. 6*b*. Whereby, the actual compressing stroke of fluid pockets 3*a*, 3*b* starts after spiral element 272 of orbiting scroll member 27 crosses over two holes 34*a*, 34*b*. The volume of the fluid pockets 3*a*, 3*b* at the time when the pockets are sealed from the suction chamber 25** and compression actually begins, is thereby reduced. In this manner, the capacity of the compressor is reduced.

A theoretical displacement volume V, of scroll type compressor is given by:

$$V = H\,RoP\,(2\phi - 3\pi)$$

where H is height of spiral element, P is pitch of spiral element, $\phi$ is final involute angle of spiral element, i.e., the complete angular extent of the spiral element from its innermost tip to its outermost tip, and Ro is given by $Ro = Rg \cdot \pi - t$, where Rg is a radius of the generating circle of the involute spiral, and t is thickness of spiral element.

Thus, for example, when the outermost involute angle $\phi_1$ is $6\pi$ and the involute angle where the compression starts when valves are open $\phi_2$ is $4\pi$ the displacement volume V2 is reduced by 44.4% from the maximum displacement volume V1.

$$\frac{V1}{V2} = \frac{2\phi_2 - 3\pi}{2\phi_1 - 3\pi} = \frac{5\pi}{9\pi} = 0.556$$

According to this construction, the capacity of the compressor unit can be easily changed because of changes in the external environment, i.e., changes in the passenger compartment temperature, and load on engine can thereby be reduced. This occurs because the fluid in the sealed off fluid pocket is leaked through the holes by operation of the magnetic valve means which is controlled by the changes in the external environment. For example, when the temperature of the fluid passing through evaporator 39 is low due to cool air passing through the evaporator, the pressure of the fluid at the outlet of the evaporator will be lowered and this pressure reduction will be sensed by the detecting means 35*b*.

Figure 4:
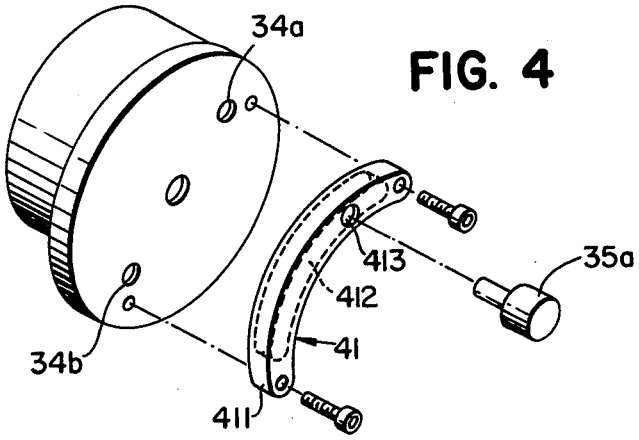
FIG. 4 is an exploded perspective view of a modification of the embodiment of FIG. 3.

FIG. 4 illustrates a modified construction of a mechanism for changing the volume in the fluid pockets. In this construction, a fluid passage means 41 connects the two holes 34*a*, 34*b*. Fluid passage means 41 comprises a passage plate 411 within which is formed a fluid passageway 412 at one of its side surfaces. An aperture 413 is formed on the plate 411 for connecting fluid passageway 412 with suction chamber 25 of rear end plate 13. A valve means, such as a single magntic solenoid valve means 35*a*, is disposed on the aperture 413 for controlling the opening and closing of aperture 413. Therefore, a single value means can modulate the displacement volume compared to the two valve means required for the first embodiment. Alternatively, the fluid passageway may be formed in circular plate 261 of fixed scroll member 26.

This invention has been described in detail in connection with the preferred embodiments, but these are examples only and this invention is not restricted thereto. It will be easily understood by those skilled in the art that the other variations and modifications can be easily made within the scope of this invention.

We claim:

1. In a scroll type fluid displacement apparatus including a housing, a fixed scroll member fixedly disposed relative to said housing and having a first end plate from which a first wrap extends into the interior of said housing, an orbiting scroll member having a second end plate from which a second end wrap extends and said first end and second wraps interfitting at an angular and radial offset to make a plurality of line contacts to define at least one pair of sealed off fluid pockets, a driving mechanism including a rotatable drive shaft connected to said orbiting scroll member to effect orbital motion of said orbiting scroll member, and a rotation preventing mechanism connected to said orbiting scroll member during the orbital motion of said orbiting scroll member, whereby said fluid pockets change volume by the orbital motion of said orbiting scroll member the improvement comprising, control means for controlling the volume at which said fluid pockets begin operating on the fluid to control the displacement volume of said apparatus, said control means including at least two holes formed through one of said end plates at symmetrical positions and valve means for controlling the passage of fluid through said holes, said holes being located within an area where during the orbiting of said orbiting scroll member said at least one pair of fluid pockets are initially formed to begin normal operation of the apparatus on the fluid and in the path of the movement of said second wrap and spaced inward of the points where said first and second wraps initially contact to form said fluid pockets, said holes being in communication with a low pressure area within said housing, and said valve means in an open position providing communication between the initially formed fluid pockets and said low pressure area to delay the operation of said apparatus on the fluid in said pockets until the second wrap passes over said holes to seal said pockets from said low pressure area, and in a closed position preventing passage of fluid past said holes so that the operation of said apparatus on the fluid begins when said first and second wraps contact to initially form said at least one pair of fluid pockets.

2. The improvement as claimed in claim 1, wherein said holes are formed on said first end plate of said fixed scroll member.

3. The improvement as claimed in claim 1 wherein said valve means is controlled by detecting means for detecing physical changes external of said compressor unit to control the operation of said valve means in response to the physical changes.

4. The improvement as claimed in claim 3 wherein said valve means is comprised of magnetic solenoid valve means at each hole for controlling the opening and closing of said holes.

5. The improvement as claimed in claims 3 or 4, wherein said detecting means is disposed at an outlet portion of an evaporator in a fluid circuit.

6. The improvement as claimed in claim 1 wherein fluid passage means is disposed between said holes for connecting the pair of fluid pockets.

7. The improvement as claimed in claim 6 wherein said fluid passage means is comprised of a passage plate within which is formed a fluid passageway.

8. The improvement as claimed in claim 6 wherein said fluid passage means is comprised of a fluid passageway which is formed in said end plate means of fixed scroll member.

9. The improvement as claimed in claims 6, 7 or 8 wherein said fluid passage means is formed with an aperture for communicating between said fluid passageway and a suction space of said housing, and said valve means is disposed at said aperture for controlling the opening and closing of the aperture in response to the physical changes.

10. The improvement as claimed in claim 9 wherein said valve means is comprised of magnetic solenoid valve means.

11. The improvement of claim 9 wherein said valve means is controlled by detecting means for detecting physical changes external of said compressor unit to control the opening and closing operation of said valve means in response to the physical changes.

12. A scroll type fluid displacement apparatus comprising:

a housing;

a fixed scroll member fixedly disposed relative to said housing and having a first end plate from which a first wrap extends into the interior of said housing;

an orbiting scroll member having a second end plate from which a second wrap extends and said first and second wraps interfitting at an angular and radial offset to make a plurality of line contacts to define at least one pair of sealed off fluid pockets;

a driving mechanism including a rotatable drive shaft connected to said orbiting scroll member to effect orbital motion of said orbiting scroll member by the rotation of said drive shaft;

a rotation preventing mechanism connected to said orbiting scroll member for preventing rotation of said orbiting scroll member during the orbital motion of said orbiting scroll member; and control means for controlling the volume at which said fluid pockets begin operating on the fluid to control the displacement volume of said apparatus, said control means including at least two holes formed through one of said end plate at symmetrical positions and valve means for controlling the passage of fluid through said holes;

said holes being in communication with a low pressure area within said housing, being located within an area where during the oribiting of said orbiting scroll member said at least one pair of fluid pockets is initially formed to begin normal operation of the apparatus on the fluid and in the path of the movement of said second wrap, and being spaced inward of the points where said first and second wraps initially contact to define said fluid pockets;

said valve means including at least one valve member movable between an open position to provide communication between said initially formed fluid pockets and said low pressure area to delay the operation of said apparatus on the fluid in said pockets until said second wrap passes over said holes to seal said pockets from said low pressure area and a closed position to prevent passage of fluid past said holes so that the operation of said apparatus on the fluid begins when said first and second wraps contact to initially form said at least one pair of fluid pockets.

13. Apparatus as claimed in claim 12 wherein said holes are formed in said first end plate of said fixed scroll member.

14. Apparatus as claimed in claim 12 wherein said valve means is controlled by detecting means for detecting physical changes external of said compressor unit to control operation of said valve means in response to the physical changes.

15. Apparatus as claimed in claim 12 wherein a fluid passage means is disposed between said holes for connecting the pair of fluid pockets.

16. Apparatus as claimed in claim 15 wherein said fluid passage means is formed with an aperture for communicating between said fluid pockets and the suction space of said housing, and said valve means is disposed at said aperture for controlling the opening and closing of said aperture.

17. Apparatus in accordance with claim 12 wherein said valve means is disposed at each hole for controlling the opening and closing of said holes.

* * * * *